US006686142B2

(12) United States Patent
Elst et al.

(10) Patent No.: US 6,686,142 B2
(45) Date of Patent: Feb. 3, 2004

(54) RADIATION-SENSITIVE EMULSION, SILVER HALIDE PHOTOGRAPHIC FILM MATERIAL AND RADIOGRAPHIC INTENSIFYING SCREEN-FILM COMBINATION

(75) Inventors: Kathy Elst, Kessel (BE); Paul Callant, Edegem (BE)

(73) Assignee: Agfa-Gevaert, Mortsel (BE)

( * ) Notice: Subject to any disclaimer, the term of this patent is extended or adjusted under 35 U.S.C. 154(b) by 152 days.

(21) Appl. No.: 10/090,243

(22) Filed: Mar. 4, 2002

(65) Prior Publication Data

US 2002/0192607 A1 Dec. 19, 2002

Related U.S. Application Data

(60) Provisional application No. 60/293,264, filed on May 23, 2001.

(30) Foreign Application Priority Data

Mar. 29, 2001 (EP) ..... 01000092

(51) Int. Cl.[7] ..... G03C 1/005; G03C 1/494

(52) U.S. Cl. ..... 430/567; 430/966; 430/570; 430/572; 430/574; 430/576; 430/577; 430/581; 430/582; 430/583; 430/584; 430/585

(58) Field of Search ..... 430/567, 966, 430/570, 572, 574, 576, 577, 587, 582–585

(56) References Cited

U.S. PATENT DOCUMENTS

| | | | | |
|---|---|---|---|---|
| 4,607,005 A | | 8/1986 | Urata | 430/550 |
| 5,041,366 A | | 8/1991 | Asano et al. | 430/567 |
| 5,296,345 A | | 3/1994 | Yamashita et al. | 430/574 |
| 5,298,384 A | * | 3/1994 | Lushington et al. | 430/567 |
| 6,573,019 B1 | * | 6/2003 | Van den Zegel et al. | 430/966 |

FOREIGN PATENT DOCUMENTS

| | | | |
|---|---|---|---|
| EP | 0 712 036 A1 | | 5/1996 |
| EP | 0 930 527 A1 | | 7/1999 |
| JP | 359116646 A | * | 7/1984 |
| JP | 407072577 A | * | 3/1995 |

OTHER PUBLICATIONS

Database WPI Section Ch, Week 199520, Derwent Publications Ltd., London, GB; Class E23, AN 1995–149870 XP002175986 & JP 07 072577 A (Fuji Photo Film Co Ltd.) Mar. 17, 1995, Abstract.

Database WPI Section Ch, Week 198433, Derwent Publications Ltd., London, GB; Class E23, AN 1984–204139 XP002175987 & JP 59 116646 A (Konishiroku Photo Ind Co Ltd.), Jul. 5, 1984, Abstract.

* cited by examiner

*Primary Examiner*—Geraldine Letscher
(74) *Attorney, Agent, or Firm*—Joseph T. Guy; Nexsen Pruet Jacobs & Pollard, LLC

(57) ABSTRACT

A chemically and spectrally-sensitized emulsion has been described, wherein said emulsion comprising (100) cubic silver halide grains with an average edge length of from 0.2 up to 1.5 $\mu$m, has been spectrally sensitized by addition at least three trimethine dyes: a main spectral sensitizer added in an amount of at least 85 mole % of all spectral sensitizers added, followed by adding a second spectral sensitizer in an amount of not more than 10 mole % and a third spectral sensitizer in an amount of at most 1 mole % wherein at least said main spectral sensitizer has two benzoxazole rings in its chemical structure, at least said third spectral sensitizer has two benzimidazole rings in its chemical structure and wherein the said second spectral sensitizer has a structure more sterically hindered than the structure of the other spectral sensitizers. A light-sensitive silver halide photographic film material coated with such emulsion and a radiographic screen/film combination has been described.

18 Claims, No Drawings

RADIATION-SENSITIVE EMULSION, SILVER HALIDE PHOTOGRAPHIC FILM MATERIAL AND RADIOGRAPHIC INTENSIFYING SCREEN-FILM COMBINATION

This application claims the benefit of Provisional Application No. 60/293,264 filed May, 23, 2001.

FIELD OF THE INVENTION

The present invention relates to a light-sensitive silver halide photographic emulsion, a material comprising said emulsion and a screen-film combination of a radiographic intensifying phosphor screen and said material.

BACKGROUND OF THE INVENTION

Cubic silver halide grains are grains which have since quite a long time been known as applicable in quite a lot of silver halide light-sensitive photographic materials, but since the early eighties many attempts have been made in order to replace them by silver halide tabular grains and to make those tabular grains suitable for use in silver halide photographic materials for quite a lot of diverse applications.

However as a global result fairly heterogeneous emulsion crystal distributions were obtained in an attempt to prepare homogenous tabular crystals populations: a common variability or variation coefficient (defined as ratio between average standard deviation on equivalent circular diameter and the said average equivalent circular diameter) of 0.30 to 0.60 has frequently been calculated, partly due to the presence of quite a large number of non-tabular grains having a sphere equivalent diameter of less than 0.3 $\mu$m. Moreover differences in thickness growth have been observed, said differences leading to unevenness as a consequence of observed differences in image tone.

Heterodispersity of grain morphology further leads to, e.g., uncontrolled chemical and spectral sensitization, lower contrast and lower covering power, thereby losing typical advantages of the said grains as referred to hereinbefore.

Until now efforts in order to get more monodisperse tabular silver halide crystal distributions in emulsion preparation have been directed towards silver halide crystals rich in silver bromide as has e.g. been described in U.S. Pat. Nos. 4,797,354; 5,147,771; 5,147,772; 5,147,773; 5,171,659; 5,248,587; 5,204,235; 5,210,013; 5,215,879; 5,250,403; 5,252,442, 5,252,453; 5,254,453; 5,318,888; 5,439,787; 5,472,837; 5,482,826 and 5,484,697 and in Research Disclosure No. 391, p. 713–723 (1996).

Many attempts have been made in order to improve the degree of homogeneity of the size and shape of the crystals but the majority of them is related with tabular grains rich in silver bromide. So radiographic materials comprising emulsions having monodisperse tabular silver brom(oiod)ide crystals have e.g. been described in U.S. Pat. Nos. 5,252,442 and 5,508,158. The same preparation methods as for the forementioned tabular grains rich in silver bromide can however not be applied as such in preparing tabular grains rich in silver chloride, especially due to the recommended presence of crystal habit modifiers or stabilizers, usually adenine or more generally aminoazaindenes, as this leads to the disadvantages set forth hereinbefore. Stabilization of the crystal habit of anisotropically grown crystals having flat parallel twins however remains an ever lasting demand.

Combinations of intensifying screens provided with luminescent phosphors in contact with light-sensitive silver halide photographic materials are conventionally used for medical diagnosis. By X-ray radiation the luminescent phosphors in the screen panel or panels are converting X-rays into visible radiation, thereby exposing the film material in contact with the said panel (for single-side coated materials as e.g. in mammography) or panels (for duplitized materials as e.g. in chest imaging).

In mammography e.g. the compressed breast is irradiated with soft X-rays emitted from an X-ray generating device and the modulated X-rays are detected with a radiographic X-ray conversion screen, also called intensifying screen, fluorescent screen or phosphor screen. The X-ray conversion screen comprises a luminescent phosphor which converts the absorbed X-rays into visible light and the emitted visible light exposes a silver halide film that is brought into contact with said X-ray conversion screen. After film processing, comprising the steps of developing, fixing, rinsing and drying, a mammogram is obtained which can be read on a light box. No other field of medical radiology demands such a high level of image quality as mammography and the ability of the mammogram to portray relevant diagnostic information is highly determined by the image quality of the screen-film system. Image quality is manifested by a number of features in the image including sharpness, noise, contrast, silver image colour and skin line perceptibility. Conventional mammography films can roughly be classified in low and high contrast types according to the value of their average gradation as defined above. The low contrast type can be characterized by a relatively low average gradation ranging from 2.0 to 2.5 whereas the average gradation of the high contrast type may range higher than 3.0. Often, high contrast films are preferred because of the higher ability to detect tiny cancers deep in the glandular tissue of the breast. If the contrast is too high, however, it may preclude visualization of both thin (i.e. the skin line) and thick tissues (i.e. the inside of the breast) in the same image due to lack of exposure latitude. Therefore, some radiologists prefer low contrast mammography films. When the contrast is low, skin line perceptibility is excellent, but then the chance of missing possibly malignant breast lesions is high. Thus a balance has to be found between contrast and exposure latitude and an example of this approach has been described in U.S. Pat. No. 5,290,655.

Maintaining the image quality constant is becoming another requirement of facilities performing mammography. Accordingly, quality control tests are executed on a regular basis in order to monitor the consistency of the performance of the X-ray equipment, the image receptors and the film processor. In order to minimize the influence of varying film processing time, temperature, chemistry and replenishment, a preferred mammography film requires a stable speed and contrast with regard to these processing parameters. As in addition, there is a general trend in the field of radiology to shorten the film processing time and likewise in the field of mammography, being driven by intensified screening programs, the interest has focused on rapid access of mammograms. As a consequence, mammography films are preferred which comprise silver halide crystals that can be processed rapidly and consistently in a dry-to-dry processing cycle of 90 seconds or less and therefore, most mammography films today comprise good developable cubic silver halide crystals. As described in EP-A 0 712 036 such cubic crystals show a stable speed and contrast upon varying processing parameters, but said cubic grain emulsions however are characterized by a very high contrast, resulting in a poor skin line perceptibility.

Especially in rapid processing applications it is very difficult to obtain the desired low fog, high speed and high covering power simultaneously. Replacing cubic grain emulsions by tabular grain emulsions is in favour of getting a high covering power at moderate coating amounts of silver halide as has been demonstrated e.g. in U.S. Pat. No. 4,414,304. Disadvantages of tabular grains however are the lower contrast than the contrast obtainable with cubic grains, the brown colour hue of developed crystals and the residual colouration of the processed image, especially in short processing cycles, due to strong adsorption of huge amounts of spectral sensitizing dye(s) at the large specific surface area, characteristic for the said tabular grains.

Making use of a mixture of cubic and tabular grains or of a multilayer arrangement of cubic and/or tabular grains in order to provide a good image tone as in EP-A 0 874 275 and in EP-A 0 770 909 respectively is more complex and less interesting from the point of view of reproducibility of the production process. Another method provided in order to get a suitable image tone has been described in EP-A 0 844 520, wherein the light-sensitive silver halide emulsion layer comprises blue coloured polymeric matting particles.

The above cited references on tabular grains are mainly concerned with high sensitive silver bromide or silver bromoiodide emulsions. As already set forth above tabular grain emulsions having a high aspect ratio are known to provide several advantages over more conventional spherical grains as e.g. a high covering power, a high (spectral) sensitivity and a lower coating weight, which saves costs in manufacturing. Said lower coating weight is especially preferred if rapid processing applications, preferably accompanied by low replenishing amounts of developer and fixer, are required, which nowadays is an ever more returning demand. In order to prevent residual colour or dye stain after said rapid processing in low replenishing conditions, it is even most favourable not to make use of antihalation dyes as those dyes are normally coated in the layer, most close to the support, so that it takes some time to leave the film. In mammography however literature is scarce with respect to the use of antihalation dyes and dye stain mostly results from the presence after processing of residual amounts from the normally used high amounts of spectral sensitizing dyes, required in high amounts in the presence of tabular grain emulsions characterized by their large surface to volume ratio. Said spectrally sensitizing dyes are well known in the art of photography, especially for green and red sensitization of flat tabular grains, whereas for blue and/or ultraviolet sensitization the number of examples is rather limited. Further it is known in mammography to use combinations of green-emitting phosphor screens with film materials containing green sensitized tabular grain emulsions. After processing of exposed tabular emulsion grains residual amounts of dyes may thus be present. Those huge amounts are particularly added in favour of high speed and high image quality (especially sharpness) in diagnostic imaging applications, where it is further of utmost importance to reduce irradiation of the patient to minimum levels.

Although not restricted to single-side coated materials, the present invention is especially useful in mammographic applications, wherein, for reasons of good image definition light-sensitive layers are present on only one side of the film support. Image formation therein proceeds with a system consisting of only one intensifying screen, wherein a high speed, a high contrast (preferably a high "toe contrast") and low residual dye stain are desired. Specific measures taken therefore have e.g. been described in U.S. Pat. No. 5,290,655; in EP-A's 0 264 788 and 0 577 027 and in Research Disclosure No. 33487 (1992), p. 161 but it is clear that any measure in order to decrease residual dye stain level, just as for duplitized or double side coated radiographic materials, without further losses with respect to sensitometry and image quality is highly desired. The said losses may become particularly prohibitive the thinner the flat tabular grains are: an enhanced specific surface resulting therefrom requires higher amounts of spectrally and chemically sensitizing compounds or agents which may cause adverse effects as there are desensitization and a decreasing decoloration ability.

Moreover sensitivity to darkroom illumination, causing fog and having an influence on sensitometric and image quality characteristics, may form a problem with respect to diagnosis.

OBJECTS OF THE INVENTION

It is an object of the present invention to provide a silver halide photographic material for mammography, said material having a low fog (partly due to low darkroom sensitivity), high speed, desired contrast (gradation) and high image quality (especially sharpness).

It is a further object of the present invention to provide a mammographic material having little coloration (residual dye stain), even after rapid processing (short processing times).

SUMMARY OF THE INVENTION

The above mentioned objects are realized by providing a chemically and spectrally-sensitized silver halide photographic emulsion composed of essentially (100) cubic silver brom(oiod)ide grains or crystals with an average edge length of from 0.2 μm up to 1.5 μm (preferably having a high degree of monodispersity), wherein said grains have been spectrally sensitized in the wavelength range from 540 nm to 555 nm by the step of adding at least three (a main, a second and a third trimethine) spectrally sensitizing dyes:

- a main spectrally sensitizing dye present in an amount of at least 85 mole %,
- a second spectrally sensitizing dye present in an amount of less than 10 mole % (but always differing from 0%), and
- a third spectrally sensitizing dye present in an amount of at most 5 mole %, preferably in an amount of not more than 3 mole % and most preferably said second spectrally sensitizing dye is added in an amount of not more than 1 mole % (but always differing from 0%) of all spectrally sensitizing dyes added, said amount being expressed in mole % based on total molar amounts of all spectrally sensitizing dyes added;

characterized in that

- at least said main spectrally sensitizing dye is a methine dye comprising first and second nuclei joined by a substituted or unsubstituted trimethine linkage, wherein both nuclei are benzoxazole nuclei, said nuclei being each substituted by one halogen atom or by a methyl group in the 5- and 5'- or 6- and 6'-position respectively; the N-atom of which has a substituted or unsubstituted alkyl chain having from 1 to 4 carbon atoms and a water-soluble group;
- at least said third spectrally sensitizing dye is a methine dye comprising first and second nuclei joined by a substituted or unsubstituted trimethine linkage, wherein both nuclei are benzimidazole nuclei, said nuclei substituted by one or more halogen atom(s) in the 5-, 5'-,6- and/or 6'-position, or by a methyl group; the N-atoms of which having a substituted or unsubstituted alkyl chain having from 1 to 4 carbon atoms and a water-soluble group on at least on one N-atom; and in that the said second spectrally sensitizing dye is a asymmetrical trimethine dye comprising first and second nuclei, independently represented by a benzoxazole or a benzimidazole nucleus, at least one of them being substituted by a hydrophobic substituent, having a higher Van der Waals volume than any other hydrophobic substituent of both other spectrally sensitizing dyes (or expressed otherwise: a structure more sterically hindered than the structure of the other spectral sensitizers), or, in the alternative, that the said second spectrally sensitizing dye is an asymmetrical trimethine dye comprising a benzoxazole nucleus and a benzimidazole nucleus, and wherein, apart from the presence on at least one N-atom of a water-soluble group, other substitutions provide an asymmetric structure.

A light-sensitive silver halide photographic film material (particularly suitable for use in mammography) has further been disclosed, said material comprising a support and on one side thereof, at least one light-sensitive emulsion layer having been coated in at least one light-sensitive emulsion layer with the chemically and spectrally sensitized emulsion as disclosed.

Moreover a radiographic screen/film combination has been described, said screen-film combination comprising a light-sensitive silver halide photographic film material as disclosed, in contact with one supported or self-supporting X-ray intensifying screen, characterized in that said supported or self-supporting X-ray intensifying screen essentially consists of luminescent phosphor particles emitting green light in the wavelength range as set forth.

Specific features for preferred embodiments of the invention have further been set out in the dependent claims.

Further advantages and embodiments of the present invention will become apparent from the following description.

DETAILED DESCRIPTION OF THE INVENTION

As has been disclosed in the statement of the present invention in a radiographic screen/film combination for recording medical diagnostic images of soft tissue, and more in particular for mammographic applications, the film material is thus characterized by the presence, at one side of a transparent support, of at least one light-sensitive silver halide emulsion layer, wherein the silver halide emulsion essentially has cubic silver halide emulsion grains or crystals, spectrally sensitized in order to optimally detect the light emitted from the X-ray conversion screen, by the method as disclosed herein. The said grains have been spectrally sensitized in the wavelength range from 540 nm to 555 nm by the step of adding at least three (a main, a second and a third trimethine) dyes:

at least said main spectrally sensitizing dye is a methine dye comprising first and second nuclei joined by a substituted or unsubstituted trimethine linkage, wherein both nuclei are benzoxazole nuclei, said nuclei being each substituted by one halogen atom or by a methyl group in the 5- and 5'- or 6- and 6'-position respectively; the N-atom of which has a substituted or unsubstituted alkyl chain having from 1 to 4 carbon atoms and a water-soluble group;

at least said third spectrally sensitizing dye is a methine dye comprising first and second nuclei joined by a substituted or unsubstituted trimethine linkage, wherein both nuclei are benzimidazole nuclei, said nuclei substituted by one or more halogen atom(s) in the 5-, 5'-,6- and/or 6'-position, or by a methyl group; the N-atoms of which having a substituted or unsubstituted alkyl chain having from 1 to 4 carbon atoms and a water-soluble group on at least on one N-atom; and in that the said second spectrally sensitizing dye is a symmetrical or asymmetrical trimethine dye comprising first and second nuclei, independently represented by a benzoxazole or a benzimidazole nucleus, at least one of them being substituted by a hydrophobic substituent, having a higher Van der Waals volume than any other hydrophobic substituent of both other spectrally sensitizing dyes.

In the alternative, according to the present invention said second spectrally sensitizing dye is an asymmetrical trimethine dye comprising a benzoxazole nucleus and a benzimidazole nucleus, and wherein, apart from the presence on at least one N-atom of a water-soluble group, other substitutions provide an asymmetric structure.

In another preferred embodiment according to the present invention the said second spectrally sensitizing dye is an asymmetric trimethine dye comprising a benzoxazole nucleus and a benzimidazole nucleus, wherein, apart from the presence on at least one N-atom of a water-soluble group, other substitutions provide an asymmetric structure.

In a further preferred embodiment according to the present invention said second spectrally sensitizing dye is a dye selected from the group consisting of the dyes I–VIII, having the formulae Dye (I)

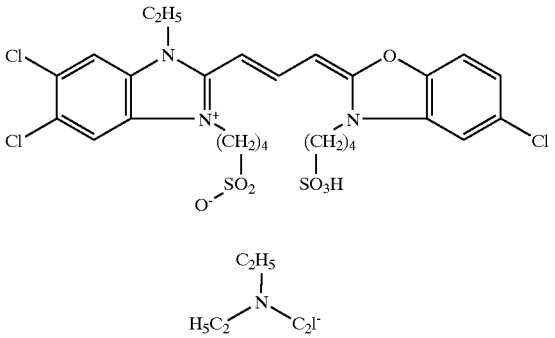

Dye (II)

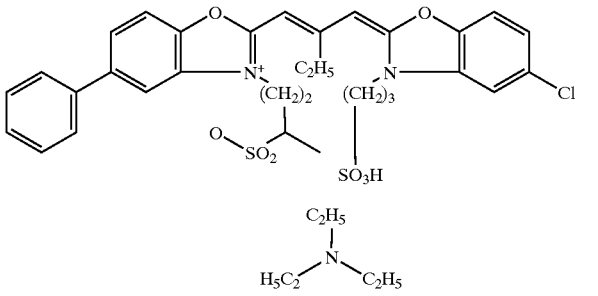

-continued

Dye (III)

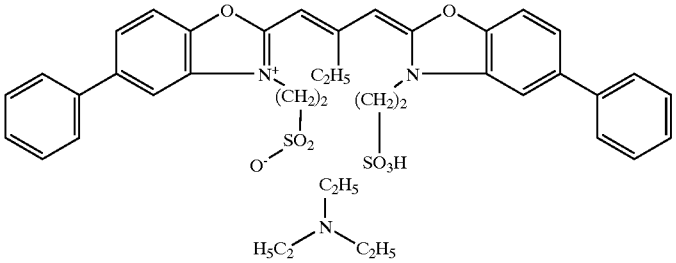

Dye (IV)

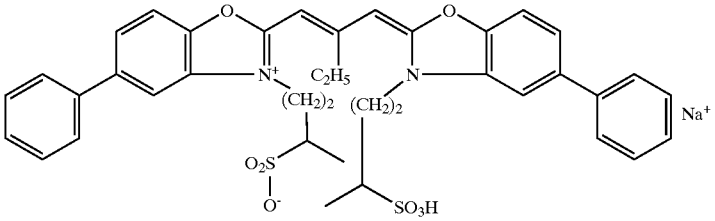

Dye (V)

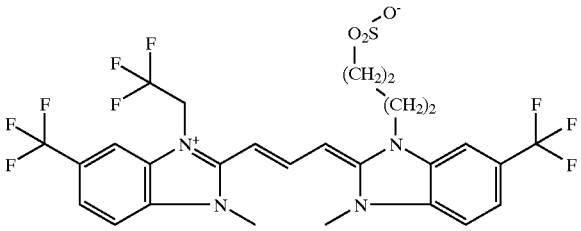

Dye (VI)

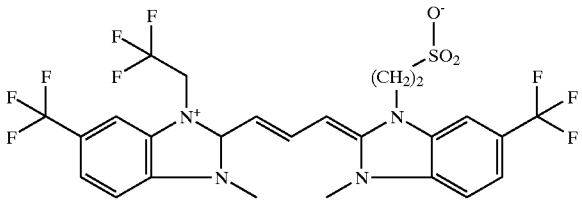

Dye (VII)

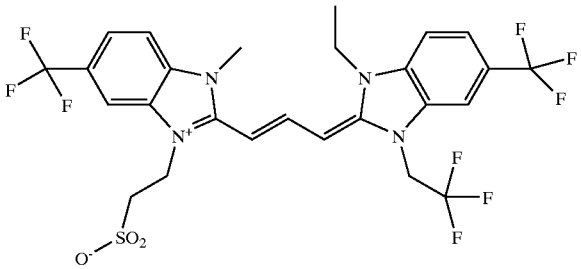

Dye (VIII)

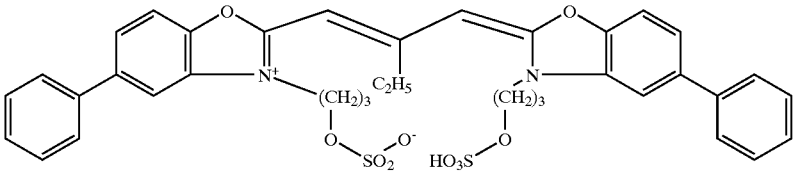

It is an essential feature, according to the present invention that the said third spectrally sensitizing dye is present in an amount of not more than 5 mole % of all spectral sensitizers, more preferably in an amount of not more than 3 mole % of all spectrally sensitizing dyes and most preferably in an amount of not more than 1 mole % of all spectrally sensitizing dyes or, in other words, in clearly lower amounts than both other spectrally sensitizing trimethine dyes, whereas the second dye should be present in an amount of less than 10 mole %, more preferably less than 5 mole % and still more preferably in an amount of about 3 mole %.

In another embodiment according to the present invention said "hydrophobic substituent" (present as substituent on the nuclei of the second spectral sensitizer) is selected from the group consisting of substituted or unsubstituted phenyl and —$(CH_2)_x$—$CF_3$, wherein x is 0 or an integer having a value of from 1 to 4. It is required to add the spectral sensitizers used in the present invention in a consecutive order as they have been numbered, in order to attain all advantages as mentioned.

Emulsion grains or crystals of the emulsion according to the present invention essentially have (100) cubic silver halide grains or crystals, more preferably having a silver brom(oiod)ide composition with an average edge length of from 0.2 $\mu$m up to 1.5 $\mu$m. The term "essentially cubic" is indicative for the presence, in an amount of at least 90%, more preferably at least 95% and even more preferably at least 99% by number of crystals having a {100} crystal habit and thus (100) crystal faces, wherein edges may be sharp or rounded-off (e.g. due to preparation methods wherein silver solubilizing growth accelerators are used such as ammonia or methionine, a thioether compound, thiazolidine-2-thione, tetra-substituted thiourea, potassium or ammonium rhodanide and an amine compound may be present during grain precipitation in order to adjust the average grain size) and wherein it is even not excluded that cubo-octaeders are present, provided that (111) crystal faces therein represent not more than 10%, more preferably not more than 5% and even more preferably not more than 1% of the total projective area of all crystal faces present, and wherein (100) faces are clearly representing the majority of the crystal faces present in the emulsions. The class of so-called cubic grains embraces (a) perfectly cubic crystals, or (b) cubic crystals with rounded corners, or (c) cubic crystals with small (111) faces at the corners (also known as tetradecahedrical grains), the total area of these (111) faces however being small compared to the total area of the (100) faces. Presence of cubo-octahedral shapes which are not excluded depends on the pAg values applied during the precipitation. So preferred methods for the precipitation of cubic grains are the pAg-balanced double- or triple-jet methods as described in EP-A's 0 712 036 and 0 610 609, since these methods provide monodispersed emulsions characterized by a narrow grain size distribution defined in that at least 95% by weight or number of the grains have a diameter within about 40%, preferably within about 30% of the average grain size and more preferably within about 10% to 20%.

The emulsion of the present invention accordingly has cubic grains having a high degree of monodispersity in that a variation coefficient on said average edge length is less than 0.20. More preferably said variation coefficient of the emulsion grains according to this invention has a low value of between 0.10 and 0.20, said variation coefficient being defined as the ratio between the standard deviation of the grain size and the average grain size. This is particularly desired as a high contrast is envisaged for the mammographic image after processing of the material according to the present invention. The silver halide grains are obtained by conventional precipitation techniques which are well known in the art and consist of the addition of aqueous solutions of silver and halide salts, e.g. silver nitrate and sodium, potassium or ammonium halide to a solution comprising a protective colloid. In order to get controlled growth use is often made of variable flow rates in order to provide (and controll) crystal growth to be performed at a higher rate and to perform precipitation in more concentrated reaction vessels which may even lead to variability coefficients over the grain distributions in the range between 0.10 and 0.20, thus corresponding with the desired homogeneity as in the present invention. If it is recommended, in favour of fine-tuning desired gradations at differing densities or sensitivity points of the sensitometric curve, e.g. in order to have a broader emulsion grain distribution, then a less homogeneous distribution will be strived after. Apart for growing the cubes in a reaction vessel at slightly higher pAg values, it is also possible and, in favour of addition of other ingredients—such as chemical and spectral sensitizers—to more uniform crystals, even recommended to prepare the most suitable cubic grain emulsion from more than one chemically and spectrally sensitized emulsion having a very narrow grain distribution. This is recommended more particularly for the light-sensitive emulsion layer in the back layer unit, which, in favour of skin line perceptibility, should contribute to the total density of the processed material, wherein the back layer unit should exhibit an optical density of at least 1.00 in the wavelength region of the exposing radiation.

The grain size of the cubic grain emulsions can be determined using conventional techniques, e.g. as described by Trivelli and Smith, The Photographic Journal, vol. 69, 1939, p.330–338, Loveland "ASTM symposium on light microscopy" 1953, p.94–122 and Mees and James "The Theory of the photographic process" (1977), Chapter II.

Precipitation of silver halide crystals suitable for use in emulsion layers according to the present invention is performed in the presence of a protective, hydrophilic colloid, which should be chosedn with care: e.g. conventional lime-treated or acid treated gelatin can be used, but also oxidized gelatin (generally known as gelatin having less than 30 p.p.m. of methionine) or a synthetic peptizer. The preparation of such modified gelatin types has been described in e.g. "The Science and Technology of Gelatin", edited by A. G. Ward and A. Courts, Academic Press 1977, page 295 and next pages. The gelatin may also be an enzyme-treated gelatin as described in Bull. Soc. Sci. Phot. Japan, No. 16, page 30 (1966). Before and during formation of the silver halide grains it is common practice to establish a gelatin concentration of from about 0.05% to 5.0% by weight in the dispersion medium. Cubic silver halide grains may also be precipitated in absence of gelatin, e.g. by making use of colloidal silica as a protective colloid in the presence of an onium compound, as described in EP-A's 0 677 773 and 0 649 051; or in the alternative by making use of cationic oxidized starch as has been disclosed e.g. in EP-A 0 758 759.

At the end of the precipitation the emulsion is made free from excess of soluble inorganic salts by a conventional washing technique e.g. flocculation by ammonium sulphate or polystyrene sulphonate, followed by one or more washing and redispersion steps. Conventional washing techniques can be found in Research Disclosure, Item 38957, Section III. Emulsion washing. Another well-known washing technique is ultrafiltration as described e.g. in EP-A 0 794 455. Finally, in order to prepare the emulsion for further sensitization actions extra gelatin or another binder material can be added to the emulsion in order to obtain a gelatin to silver ratio wherein the emulsion remains colloidally stable during said further actions. So in order to enhance speed of the cubic silver halide emulsion grains chemical sensitization is applied thereto according to the procedures described in e.g. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in the above mentioned literature, chemical sensitization can be carried out by effecting the ripening in the presence of small amounts of compounds containing sulphur, selenium or tellurium e.g. thiosulphate, thiocyanate, thiourea, selenosulphate, selenocyanate, selenoureas, tellurosulphate, tellurocyanate, sulphites, mercapto compounds, and rhodamines. In a preferred embodiment, these compounds or combinations thereof are applied in combination with a noble metal salt, preferably a gold complex salt, but also salts of platinum, palladium and iridium as described in U.S. Pat. No. 2,448,060 and GB-A 618,061 may be used. Description of chemical sensitization techniques can be found in Research Disclosure, Item 38957, Chapter IV. Additions of sulphur and/or selenium and/or tellurium and gold may be carried out consecutively or simultaneously. In the latter case the addition of goldthiosulphate, goldselenosulphate or goldtellurosulphate compounds may be recommended. So it has e.g. been set out in EP-A 0 712 036 that especially silver bromide and silver bromoiodide emulsions with cubic crystal habit are showing favourable development characteristics with respect to high image quality, without the risk of high fog densities, if the said emulsions are chemically sensitized with high amounts of gold sensitizer. The amount of gold, used in the chemical ripening of emulsions according to the present invention, is preferably in the range of 25 to 45 p.p.m. vs. the amount of metallic silver. Optionally, small amounts of dopants in form of complexing agents of Rh, Ru, Os, Pt or Ir, can be added if not yet performed in the course of grain precipitation in order to get grain occlusions other than silver and halide as disclosed in Research Disclosure, Item 38957, Section I; or in more general terms of transition metal hexacoordination complexes as dopants for increasing imaging speed by providing or as so-called SET's (shallow electron trapping agents as described in Research Disclosure, Vol. 367, November 1994, Item 36736. Also reductors may be added as chemical sensitizers as e.g. tin compounds as described in GB-A 789,823, amines, hydrazine derivatives, formamidine-sulphinic acids, and silane compounds. The chemical sensitization can also proceed in the presence of phenidone and/or its derivatives, a dihydroxybenzene as hydroquinone, resorcinol, catechol and/or a derivative(s) thereof, one or more stabilizer(s) or antifoggant(s), one or more spectral sensitizer(s) or combinations of said ingredients. Pretreatment with small amounts of oxidizing agents before adding the already mentioned chemical sensitizers may be useful in order to optimize the attainable fog to sensitivity relationship.

In a preferred embodiment, these compounds or combinations thereof are applied in combination with a noble metal salt, preferably a gold complex salt, but also salts of platinum, palladium and iridium as described in U.S. Pat. Nos. 2,448,060 and 5,759,760 and in GB-A 618,061 may be used. Amounts of gold, used in the chemical ripening of emulsions in order to get the most preferred contrast in the toe portion of the sensitometric curve have been disclosed e.g. in EP-A's 0 610 609 and 0 712 036. Additions of sulphur and/or selenium and/or tellurium and gold may be carried out consecutively or simultaneously. In the latter case the addition of goldthiosulphate, goldselenosulphate or goldtellurosulphate compounds may be recommended. Optionally, small amounts of compounds (complexing agents) of Rh, Ru, Os or Ir can be added. Also reductors may be added as chemical sensitizers as e.g. tin compounds as described in GB-A 789,823, amines, hydrazine derivatives, formamidine-sulphinic acids, and silane compounds. The chemical sensitization can also proceed in the presence of phenidone and/or its derivatives, a dihydroxybenzene as hydroquinone, resorcinol, catechol and/or a derivative(s) thereof, one or more stabilizer(s) or antifoggant(s), and one or more spectral sensitizer(s) applied as claimed, or combinations of said ingredients.

According to the present invention a light-sensitive silver halide photographic film material is provided, said material comprising a support and on one side thereof, at least one light-sensitive emulsion layer having been coated in at least one light-sensitive emulsion layer with the chemically and spectrally sensitized emulsion as disclosed hereinbefore and as claimed.

According to the present invention the material is coated with a (green) spectrally-sensitized light(radiation)-sensitive emulsion layer, or, in the alternative, more than one emulsion layer having cubic emulsion grains coated in only one layer unit, being the front layer unit of the mammographic material, which is mounted in a screen/film system, in intimate contact with the (light-emitting intensifying) screen, wherein the radiation-sensitive silver brom(oiod)ide grains are containing more than 50 mole % of silver bromide and less than 4 mole % of silver iodide, based on total molar silver amounts. In a more preferred embodiment the said radiation-sensitive silver halide grains are silver bromoiodide grains, containing at most 1 mole % of silver iodide, based on silver and even pure silver bromide emulsions are not excluded. Silver iodide present in lower amounts than silver bromide can be distributed in a homogeneously (continuously) or heterogeneously (for so-called "core-shell emulsions" having a core wherein iodide concentrations are lower or higher than in the shell or shells adjacent thereto). In another embodiment pure silver bromide cubes may still be "doped" with silver iodide by application of the so-called "conversion"-technique, wherein silver iodide is formed by conversion at the grain surface after addition of organic or inorganic compounds relasing iodide ions, such as potassium iodide or the iodide releasing compounds described in EP-A's 0 563 701, 0 563 708 and 0 651 284. In still another embodiment silver iodide is added in form of ultrafine silver iodide grains of about 0.050 um or even smaller (also called "micrate emulsions") after stopping precipitation in the precipitation method or after having ended precipitation, so that silver iodide is located at dedicated sites in the cubic grains.

The silver halide grains present in a mammography film are spectrally sensitized in order to optimally detect the light emitted from the X-ray conversion screen, by the method disclosed hereinbefore in the statement of the present invention in order to get a preferred mammography film, further characterized by a spectral sensitivity ranging from 5 to 130 $\mu J/m^2$ measured at the emission maximum of the X-ray conversion screen, said spectral sensitivity being defined herein as the amount of exposure to light of a given wavelength required to obtain an optical density Dmin+1.0 after processing.

So according to a preferred embodiment the front layer unit wherein the chemically and spectrally sensitized cubic grain emulsions are coated, have a silver halide amount, expressed as equivalent amount of silver nitrate, of less than 9.0 g/m2 and more preferably in the range from 6.5 to 8.5 g/m2. The radiation-sensitive cubic silver halide emulsion grains therein have an average grain size in the range of from 0.45 um up to 0.80 $\mu$m. Coating amounts of hardenable hydrophilic colloid, composing the front layer unit are, in a preferred embodiment, limited to less than 6.0 g/m2, and coating amounts of non-hardenable hydrophilic colloid are limited to less than 60 weight % thereof; in order to ? provide the desired sensitometric and drying properties within the short running time (within 120 seconds, and more preferably less than 90 seconds) of the processing cycle, wherein subsequent processing steps are a developing step, a fixing step, a rinsing step and a drying step, with, inbetween those steps, one or more rinsing steps. In those rapid processing applications it may be advantageous to divide the total amount of silver, normally coated in the front layer unit, between the said front layer unit and the backing layer unit. In order to provide a speed difference of from 0.30 up to 1.00 log (Exposure) between the front layer unit and the back layer unit, as described therein, the said back layer unit is coated with radiation-sensitive cubic silver halide grains accounting for less than ⅓ (but not less than ⅕) of the total radiation-sensitive silver halide present in the film, wherein said cubic grains having an average grain size of from 0.25 $\mu$m up to less than 0.55 $\mu$m. The hydrophilic backing layer unit coated on the back major face of the support further contains hardenable hydrophilic colloid limited to less than 3.0 g/m2, (more preferably in the range from 2.0 to 2.5 g/m2) and non-hardenabe hydrophilic colloid limited to less than 10 weight % thereof. A total amount of silver halide coated in the material (sum of coating amounts at both sides for both—front and back—layer units), expressed as silver nitrate again, should be in the range from 6.0 up to 9.0 g/m2. In favour of attaining that speed difference the image-forming portion in the material according to the present invention is, as a consequence of its composition, as disclosed hereinbefore, further comprised of a hydrophilic front layer unit coated on the front major face of the support capable of absorbing up to at least 60%, and more preferably even more than 70%, of the exposing radiation. It is clear that in such a layer arrangement as set forth hereinbefore with light-sensitive emulsion layers at both sides of the transparent support, which is typically a blue coloured polyethylene terephtalate (PET) film having a thickness of 175 μm, the said arrangment is not coated symmetrically: according to the present invention the radiographic material is coated with a hydrophilic front layer unit coated on the front major face of the support (to be contacted with the sole intensifying screen when exposed to "soft" X-rays, generated from a device with a tube voltage of 20 kV to 40 kV, as is typical for mammographic applications) wherein the front layer unit is capable of reaching a maximum density of more than 3.00, and even more preferably more than 3.5, after processing and wherein sensitivity (speed), measured at a density of 1.00 above fog, is higher for the front layer unit than for the back layer unit in an amount of from 0.30 up to 1.00 log (Exposure) and in a more preferred embodiment the back layer unit has a speed ranging from 0.4 log E to 0.6 log E slower than the front layer unit. So the cubic grains in the back layer unit, exhibiting a speed that ranges from 0.3 log E to 1.0 log E slower than in the front layer unit, provide facilitating visualization of anatomical features in the region of the skin-line. Said "E" stands for "Exposure" and speed (sensitivity) is measured at a density of 1.0 above fog for the front as well as for the back layer unit. In that case, hardenable hydrophilic colloid in the whole back layer unit should be limited to less than 3.0 g/m2, and should, more preferably, be situated in the range from 2.0 to 2.5 g/m2, whereas in the whole front layer unit it should be limited to less than 4.0 g/m2, more preferably be situated in the range from 3.5 to 3.9 g/m2. In the back layer unit the non-hardenabe hydrophilic colloid, the presence of which is preferably limited to the light-sensitive emulsion layer thereof, should further be limited to less than 10 wt %, but more than 5 wt %, versus the total amount of hardenable hydrophilic colloid present in the whole back layer unit. Opposite thereto, in case of such a layer arrangement, in the front layer unit the non-hardenabe hydrophilic colloid should be present in the light-sensitive emulsion layer thereof in an amount of more than 50 wt % and even up to 60 wt %, versus the amount of hardenable hydrophilic colloid present in the light-sensitive layer, which means that in the whole front layer unit the said non-hardenable hydrophilic colloid should be present in an amount of about 30 wt % (preferably in the range from 25 up to 35 wt %). With respect to the terminology "whole back layer unit" it is understood that, besides the subbed support a "density providing layer" should be present, situated farther from the said support, and adjacent to the emulsion layer, and that "density providing layer" should further be covered by an outermost protective antistress layer as a topcoat layer. Otherwise the terminology "whole front layer unit" is indicative for, besides the subbed support, for a light-sensitive emulsion layer adjacent to the said subbed support, wherein said emulsion layer is further covered by an outermost protective antistress layer as a topcoat layer, and wherein this protective layer should be hardened to an extent in order to avoid scratches due to contact made with the intensifying screen during exposure.

With respect to the subbing layers coated directly on the thus provide subbed support, it is clear that these layers are coated (preferably during stretching the polyester in order to get the support of the desired thickness) in order to improve the adhesion of the adjacent radiation-sensitive emulsion layer of the front layer unit and the non-radiation sensitive dye containing layer of the back layer unit to the support (in a common layer arrangement of a "classic" mammographic film material) or, in the alternative, the "slower" adjacent radiation-sensitive emulsion layer of the back layer unit as mentioned hereinbefore. In a "classic" mammographic film material an undercoat layer between the emulsion and subbing layer(s) and a protective layer on top of the emulsion layer(s) is present. Additional non light-sensitive intermediate layers are optional. Of crucial importance however, within the spirit of the present invention, is the particular combination of spectrally sensitizing dyes as applied to the cubic grains in order to provide light-sensitive layers in the mammographic material according to the present invention that can, after having been exposed in a film/screen system according to the present invention, be processed in a rapid processing cycle without leaving dye stain, leading to misinterpreted diagnosis.

The layer arrangements of the whole front and back layer units described hereinbefore should further be constructed in such a way that after processing (inclusive for the drying step) no curl of the processed film material occurs, as examination of the image would become more problematic. A solution therefore has been described in EP-Application No. 00201286.2 filed Apr. 10, 2000.

In that invention a single-side coated light-sensitive silver halide photographic film material has been described, comprising, on one side of a subbed support, one or more light-sensitive silver halide emulsion layer(s) overcoated with an outermost protective layer; said emulsion layer(s) having silver halide grains dispersed in binder, wherein said silver halide is coated in a total amount, expressed as an equivalent amount of silver nitrate of more than 5 g per $m^2$, a latex polymer present in an amount of less than 30% by weight versus said binder, and, at the other side of said support, a backing layer, covered with a protective outermost layer, characterized in that at least said backing layer is provided in at least one layer thereof, besides a cross-linked or cross-linkable first binder, with an organic component as a second binder, wherein said organic component is free from cross-linking upon reaction with a hardener and wherein said organic component is a polymer selected from the group consisting of dextran having a molecular weight of not more than 20000 and polyacrylamide having a molecular weight not more than 20000. Said organic component free from cross-linking upon reaction with a hardener is present therein in an amount of more than 50% by weight of a total binder amount calculated as sum of said first and second binder.

In the present invention use is thus made again of a first cross-linkable binder, called hardenable hydrophilic colloid in the present invention and present in amounts in the front layer unit and in the back layer unit as disclosed hereinbefore, besides a second binder, called herein "non-hardenable hydrophilic colloid", being a polymer selected from the group consisting of dextran having an average molecular weight from 1000 up to 100000, polyacrylamide having an average molecular weight from 1000 up to 100000, polyvinyl-pyrrolidone, polyvinyl alcohol and gelatin of the type which is free from cross-linking upon reaction with a hardener, more preferably a polymer selected from the group consisting of dextran having a molecular weight of not more than 20000 and polyacrylamide having a molecular weight not more than 20000. Amounts at both sides of the support will differ from those disclosed in the cited EP-Application in case wherein light-sensitive layers are present at both sides of the support as an equilibrium in order to prevent the processed material from curling has to be sought, moreover as presence of coating amounts of silver at both sides causes further complications: apart from differing amounts of coated silver halide, differing total amounts of hydrophilic polymer at both sides of the support are present in that the topcoat layer of the front layer unit is coated from an amount of gelatin of about 1.0 up to 1.2 g/m2, corresponding with a coating amount twice as high as coated in the topcoat layer of the back layer unit, and wherein, even when the "density providing layer" in the back layer unit contains about 0.5 g/m2 of gelatin amounts of gelatin in the back layer unit are not exceeding 60 wt % of the total amount of gelatin coated in the whole front layer unit.

Therefore amounts of hardener should be added to the respective layer units at both sides in order to get a perfect balance for the material when leaving the processor as a dried film material bearing the image to be examined. As a consequence amounts of water absorption before processing should be different at the front layer unit side versus at the back layer unit side due to the required differences in hardening degrees, but should become about equal after processing: as dextran is a non-hardenable polymer binder, present in higher amounts in the emulsion layer(s) of the front layer unit—more than 0.5 g/m2, more preferably more than 1.0 g/m2 and even more preferably more than 1.5 g/m2) in an amount of about 10 times the amount in the layers of the back layer unit, the highest amounts will leave the photographic material from the front layer unit during processing, and more particularly during the rinsing step, the better for dextran having a lower molecular weight (M.W. of 10000 even being more preferred than a M.W. of 20000; differentiation in M.W. in front and back layer unit moreover leaving further degrees of freedom in optimizing the layer built-up of the material of the present invention). After the drying step a processed material free from ennoying curl properties is thus attained thanks to a suitable balance of hydrophilic colloid gelatin binder in front and back layer unit.

As a hardenable hydrophilic colloid binder of the layers, gelatin is used as a preferred polymer binder material, which can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. methylol-urea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with onium compounds as disclosed in EP-A 0 408 143.

Topcoat layers present as outermost layers at both sides of the material according to the present invention have a protective function and are coated from hydrophilic colloid in an amount of from about 1.1 g/m2 and 0.5 g/m2 in the front and in the back layer unit respectively. In one embodiment a density providing layer is present in the back layer unit of the single-side coated material. In case wherein a light-sensitive layer is present in the backing layer, this density providing layer is situated farther from the support than the emulsion layer(s), it represents a layer containing a dye in an amount in order to provide a density of about 0.40 before, and less than 0.10 after processing, due to decolorization of said dye in an alkaline developer. In a further embodiment the dye exhibits a half peak absorption bandwidth over the spectral region of peak emission by the intensifying screen. Accordingly preferred dyes suitable for use in the density providing layer have been described in EP-A's 0 489 973, 0 586 748, 0 587 229, 0 587 230, 0 656 401, 0 786 497 and 0 781 816, as well in the US-A's corresponding therewith. Particularly preferred is the dye according to the formula(IX) hereinafter, the preparation method of which has been described in U.S. Pat. No. 5,344,749.

(IX)

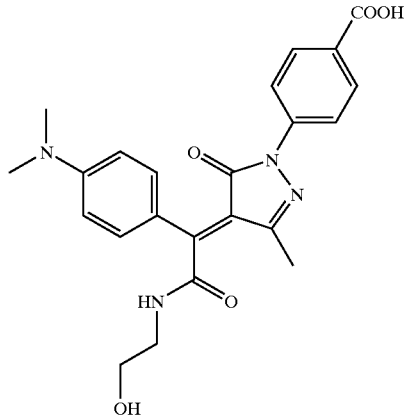

Methods in which dye dispersions can be prepared have been described in EP-A's 0 549 486, 0 602 428, 0 724 191, 0 756 201, 0 762 193 and 0 762 194. Examples of typical so-called ultrafine (less than 1 $\mu$m) "solid particle dispersions" and the method of preparing them can be found in EP-A's 0 299 435, 0 323 729, 0 351 593, 0 387 923, 0 524 498, and in U.S. Pat. No. 4,988,611; without however being limited thereto. Said dyes can also be added in the form of a solid silica particle dispersion as disclosed in EP-A 0 569 074. Still another technique to obtain ultra fine dye dispersions consists in acidifying a slightly alkaline coating composition "in situ" just before coating it onto the supporting layer. Further useful information about dyes having decolorizing characteristics in alkaline processing solutions can be found in Research Disclosure, Item 38957, Chapter VIII. Presence of such dye(s) in adapted amounts is not only recommended to adjust the sensitivity of the different emulsion layers and eventually the required contrast, but also in order to reduce scattering of exposure radiation and thus to enhance sharpness.

Apart from the said dye or dyes providing a density of about 0.40 in the back layer unit, the radiographic material according to the present invention has a spectral sensitivity maximum by the adsorption of spectral sensitizers disclosed hereinbefore, absorbing light from the phosphors prompt emitting light in the wavelength range from 540 to 555 nm after having been irradiated with X-rays, said maximum corresponding with an exposure amount from 5 to 80 microjoules per m2 required in order to obtain an optical density of Dmin+1.0 after processing.

Other dyes, which per se do not have any spectral sensitization activity, or certain other compounds, which do not substantially absorb visible radiation, can have a supersensitization effect when they are incorporated together with spectral sensitizing agents into the emulsion. Suitable supersensitizers are e.g. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510 as well as cadmium salts, although nowadays to be avoided, due to ecological considerations, and azaindene compounds.

The silver halide emulsions suitable for use in hydrophilic layers of the film material according to the present invention may also comprise compounds preventing the formation of a high minimum density or stabilizing the photographic properties during the production or storage of photographic materials or during the photographic treatment thereof. Many known compounds may be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercaptotetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds which can be used as fog-inhibiting compounds are those described in Research Disclosure No. 17643 (1978), Chapter VI; in Research Disclosure, Item 38957, Chapter VII and in Item 18431, Chapter II. These fog-inhibiting agents or stabilizers may be added to the silver halide emulsion prior to, during, or after the ripening thereof and mixtures of two or more of these compounds can be used.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, siliconepolyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitisation and development acceleration.

Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0,634,688 and 0,674,215, which are incorporated herein by reference. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. as those described in Research Disclosure, Item 38957, Chapter IX, particularly referring to coating physical property modifying addenda, as coating aids (A), plasticizers and lubricants (B), antistatic agents (C), and matting agents (D). Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylo-nitriles, olefins and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides or a polymer latex;, polythiopene (and more particularly PEDT) and the like.

Non-neutral silver image colours obtained after processing, due to the colour of the silver thus formed, can be corrected by increasing the optical density in the red region of the visible spectrum by adding suitable dyes to the support or any coated layer. This non-image wise colour correction method has been disclosed in references as e.g. JP-A's 03-100645, 01-029838, 01-312536, 03-103846, 03-094249, 03-255435, 61-285445; issued EP-A 0 271 309 and U.S. Pat. No. 4,861,702. This method however may result in an excessive base+fog density of the photographic material and therefore, an alternative way consists in an image-wise colour correction by using colour-forming developers, which are blue coloured in their oxidized form. Examples thereof have been summarized in JP-A's 03-153234, 03-154043 and 03-154046. In JP-A's 03-156447 and 03-157645 the adsorption of a blue coloured dye as a function of exposure has further been disclosed.

According to the present invention a radiographic screen/film combination is further claimed, comprising the light-sensitive silver halide photographic film material as disclosed hereinbefore, in contact with one supported or self-supporting X-ray intensifying screen, characterized in that said supported or self-supporting X-ray intensifying screen essentially consists of luminescent phosphor particles' emitting green light in the wavelength range from 540 nm up to 555 nm.

After image-wise exposure by light emitted by the intensifying screen and processing the image thus obtained, an average contrast or gradient in the range from 2.5 up to 3.5, measured over a density above fog in the range of from 0.25 to 2.50, is thus attained, wherein said image-forming portion is comprised of layer units permeable for aqueous processing solutions, said layer units being a hydrophilic front layer unit coated on the front major face of the support wherein the front layer unit is capable of reaching a maximum density of more than 3.00 and a hydrophilic back layer unit coated on the back major face of the support, wherein sensitivity (speed), measured at a density of 1.00 above fog, is higher for the front layer unit than for the back layer unit in an amount of from 0.30 up to 1.00 log (Exposure), thanks to the presence in both, the front layer unit and the back layer unit, of the presence of one or more light-sensitive silver halide emulsion layer(s) coated with emulsion crystals, essentially having a cubic crystal habit.

Processing of the exposed material after exposure of the screen/film material of the present invention as claimed preferably includes the steps of developing, fixing and drying, and is performed within 120 seconds or less and more preferably within 90 seconds or less. An important advantage of the dual- or double-side coated radiographic elements for soft tissue imaging is that they are much better suited for rapid processing applications than radiographic elements containing a single emulsion layer unit. This suitability for rapid processing is particularly due to the fact that high amounts of silver are not restricted to presence in only one radiation-sensitive emulsion layer and to the fact that, opposite to duplitized films as for chest imaging in radiology, low cross-over can only be attained the presence of two antihalation layers, interposed between the support and each emulsion layer unit. This allows the amount of hydrophilic colloid coated on each side of the support to be decreased further if compared with amount spresent in the said duplitized films. Rapid processing in mammographic applications, more preferably related with hardener-free processing solutions although not limited thereto, has been described in EP-A's 0 610 609, 0 712 036 and 0 874 275 and is perfectly suitable for use in the present application.

A radiological method for obtaining a diagnostic image for mammography is moreover provided by application of the present invention, said method comprising the steps of mounting a film-screen system by bringing a photographic material as disclosed herein into contact with a radiographic X-ray conversion screen; and processing said photographic material in a total dry-to-dry processing time of from 38 seconds up to less than 120 seconds, and, more preferably, in a dry-to-dry processing time of from 45 up to 90 seconds. Enhancement of the hardening degree of the coated material provides the possibility to use hardener free processing solutions. This opens the way to one-part package chemistry and concentration regeneration, reducing the volume of chemicals and the amount of packaging material, which is highly requested from the point of view of ecology. Further lowering the coated amount of silver halide crystals is in favour of archivability due to a higher fixation capacity, whereas an enhanced hardening degree is in favour of a lower water absorption and a higher drying capacity in the processing, avoiding sticking phenomena. Lower amounts of coated silver halide crystals that are causing less scattering from the incident light radiating from the intensifying screen during exposure and the high gradations observed after processing are two important factors in favour of the high definition of the obtained images, enhancing its diagnostic value.

Sensitometric curves of processed film materials are known to show the plot of optical density (D) as a function of relative logarithmic exposure (logE). Important characteristics of mammographic film materials in particular, besides the preferably low fog and high speed (defined as the log E(xposure) at which the optical density is equal to minimum density Dmin+1.0) and contrast are the skin line point (SL) being defined herein as the point of the sensitometric curve where log E equals the "Speed Point"+0.8.

A practical mammogram is normally obtained by subjecting a film-screen system to X-ray exposure. In diagnostic image formation any commercially available X-ray generating device may be used, providing an exposure to soft X-rays with a tube voltage of 20 to 40 kV. A preferred luminescent phosphor coated in the X-ray conversion screen is Gd2O2S:Tb, which emits green light in the wavelength range from 540 tot 555 nm. Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-A 1,489,398.

The thickness of the phosphor layer depends on the amount of coated phosphor required in order to obtain the desired screen speed. A preferred intensifying screen used in combination with the film material according to this invention is characterized by a phosphor coating weight of at least 45 mg/cm$^2$ and a phosphor to binder ratio of at least 97:3 as described in EP-A 0 712 036. In the screen/film image-forming system disclosed in this invention the features of the intensifying screen emitting green light are at least as important as the features offered by the silver halide photographic material used in this system. Image quality, i.a., granularity and sharpness are measured at the processed silver halide photographic film that is used in combination with the said intensifying screen. More in detail it is well-known that sharper images are obtained with phosphor particles of smaller mean particle size, but light emission efficiency declines with decreasing particle size. Thus, the optimum mean particle size for a given application is a compromise between imaging speed and image sharpness desired.

The synergistic effect obtained between image speed and image sharpness are a function of, i.a., the coated amount of phosphor, optionally presence of a coloured dye in the said coated phosphor layer and the reflectance of the support on which the phosphor layer was coated. A preferred phosphor coated in the intensifying screen for use in the film/screen system according to the present invention is Gd2O2S:Tb. Said phosphor and the use in intensifying screens has been described e.g. in U.S. Pat. Nos. 3,872,309; 4, 130,429; 4,912,333; 4,925,594; 4,994,355; 5,021,327; 5,107,125 and 5,259;016 and in GB 1,489,398. As is well-known the thickness of the phosphor layer may differ depending on the amount of phoshor used. Usually said thickness is within the range of from 50 to 1000 $\mu$m, preferably from 50 to 500 um and more preferably from 150 to 250 $\mu$m. The coated amouns of phosphor(s) vary depending on the desired screen speed as has been described in EP-A 0 592 724. More details about intensifying screens and coating methods thereof, in order to provide an optimized handling and excellent speed and image definition have been described in EP-A's 0 510 753 and 0 510 754 and in PCT-Applications WO 94/530 and WO 94/531.

While the present invention will hereinafter be illustrated by working examples representing preferred embodiments thereof, it will be understood that it is not intended to limit the invention to those embodiments.

EXAMPLES

Example 1

Preparation of AgBr(I) Cubic Grain Emulsion:

Precipitation:

To 1 l of a solution, containing 15 g of methionine and 50 g of gelatine, adjusted to a pH of 5.8, were added, at 60° C., by double jet addition, a 2.94 M solution of $AgNO_3$ at a constant flow rate of 5.7 ml/min during 5 minutes and a solution of a mixture of 2.91 M of KBr and 0.03 M of KI at a flow rate controlled in order to maintain pAg constant corresponding with a value of 89 mV vs. Ag/AgCl(sat.) reference electrode. Then the flow rate of the $AgNO_3$ solution was increased linearly up to 21 ml/min during 72 minutes and 46 seconds. The cubic grains thus prepared were composed of 99 mole % AgBr and 1 mole % AgI, based on silver, with an average grain size of 0.70 $\mu$m.

Chemical Ripening Conditions:

pH 6.0, optimized quantities of sodium thiosulphate, chloro auric acid, ammonium thiocyanate, sodium toluene thiosulphonate and sodium sulphite.

Coating of the Materials

Preparation of the Film Material.

Before coating each emulsion was stabilized with 1-p-carboxy-phenyl-5-mercaptotetrazole and after addition of the normal coating additives the solutions were coated simultaneously together with a protective layer containing 1.3 g gelatin per m$^2$ on one side of a polyethylene terephthalate film support having a thickness of 175 $\mu$m. The resulting photographic material contained on the said one side an amount of silver halide corresponding with an amount of 7 grams of silver, expressed as silver nitrate, per m$^2$. At the opposite side a conventional anti-curl and anti-halation layer was applied.

Samples of these coatings were exposed with green light of 540 nm during 0.1 seconds using a continuous wedge and were processed.

The processing was run in developer G138i® (trademark product from Agfa-Gevaert N. V., Mortsel, Belgium), followed by fixing in fixer G334®, and rinsing at the indicated temperature of 35° C. for a total processing time of 45 seconds.

In Table 2 the sensitometric results obtained have been given. The density as a function of the light dose was measured and therefrom were determined the following parameters:

- fog level F (with an accuracy of 0.001 density), multiplied by a factor of 1000;
- the relative speed S at a density of 1 above fog (an increase of the said speed with a factor of 2 gives a speed value that is 0.30 lower as the relation is logarithmic and as less light is needed to get the desired density), multiplied by a factor of 100;
- the darkroom light sensitivity (DRLS): determined as density (multiplied by 1000) after processing a material having been illuminated during 180 seconds at a distance of 810 mm from darkroom light with a darkroom density difference between exposed and unexposed part of the film, the exposed part being exposed to darkroom light during 3 minutes with a darkroom filter GBX2, so that the light intensity at the film was 36±0.5 lux at the site of the strips to be exposed.

Stain Level:

1 (=absence of stain or acceptable level)
2 (=stain level acceptable)
3 (=stain level not acceptable)

TABLE 1

| Matl No. | 2nd Dye (No.) | Amount vs. Dye 1 (%) | 3rd Dye (No.) | Amount vs. Dye 1 (%) |
|---|---|---|---|---|
| 1 | — | — | — | — |
| 2 | 2 | 3 | — | — |
| 3 | 3 | 3 | — | — |
| 4 | 4 | 3 | — | — |
| 5 | 2 | 10 | — | — |
| 6 | 3 | 10 | — | — |
| 7 | 4 | 10 | — | — |
| 8 | 2 | 3 | 5 | 1 |
| 9 | 3 | 3 | 5 | 1 |
| 10 | 4 | 3 | 5 | 1 |
| 11 | 2 | 10 | 5 | 1 |
| 12 | 3 | 10 | 5 | 1 |
| 13 | 4 | 10 | 5 | 1 |

As can be concluded from the superior results obtained for Coating Materials Nos. 8–10 as has been shown in Table 2 hereinafter (lowest fog, highest speed, lowest darkroom sensitivity and better dye stain level if compared with Coating Materials Nos. 11–13), the combination of dyes as set forth in the statement of the invention, whether or not being symmetrical or asymmetrical for the second dye, provided that the conditions as set forth in the statement of the present invention are fulfilled, indeed provides a solution in order to reach the objects of the present invention.

TABLE 2

| Matl. No. | F (× 1000) | S (× 100) | DRLS (× 1000) | Stain Level |
|---|---|---|---|---|
| 1 (comp) | 182 | 158 | 27 | 1 |
| 2 (comp) | 185 | 157 | 29 | 1 |
| 3 (comp) | 184 | 157 | 38 | 1 |
| 4 (comp) | 187 | 158 | — | 1 |
| 5 (comp) | 188 | 156 | 28 | 3 |
| 6 (comp) | 199 | 155 | 40 | 3 |
| 7 (comp) | 183 | 154 | 25 | 3 |
| 8 (inv) | 183 | 155 | 38 | 1 |
| 9 (inv) | 187 | 153 | 47 | 1 |
| 10 (inv) | 183 | 154 | 28 | 1 |
| 11 (comp) | 184 | 154 | 39 | 2 |
| 12 (comp) | 203 | 152 | 55 | 2 |
| 13 (comp) | 186 | 152 | 30 | 2 |

Dye 1

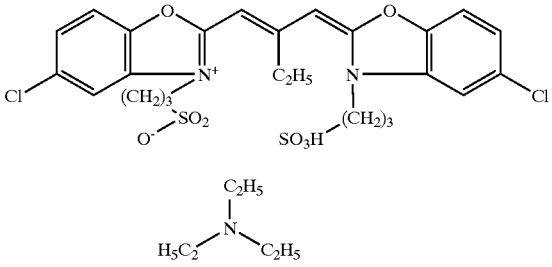

Dye 2

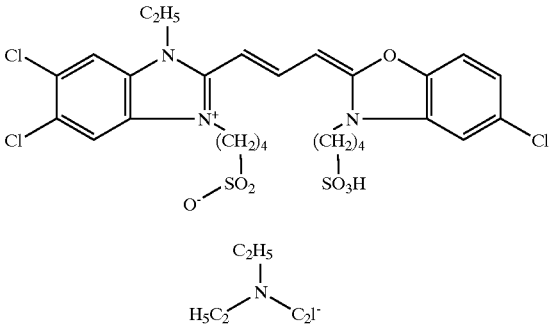

Dye 3

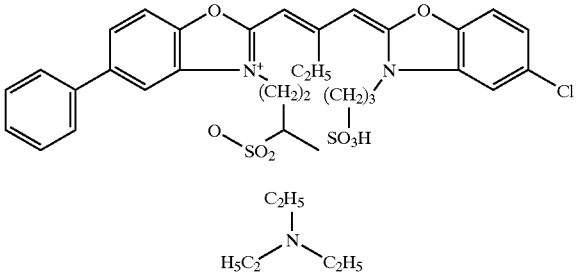

-continued

Dye 4

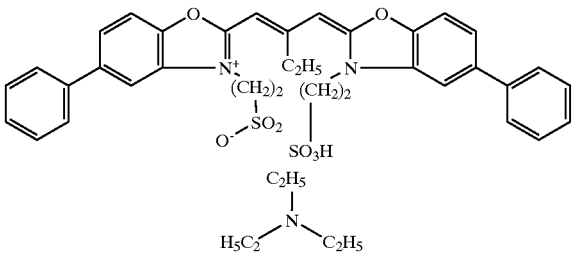

Dye 5

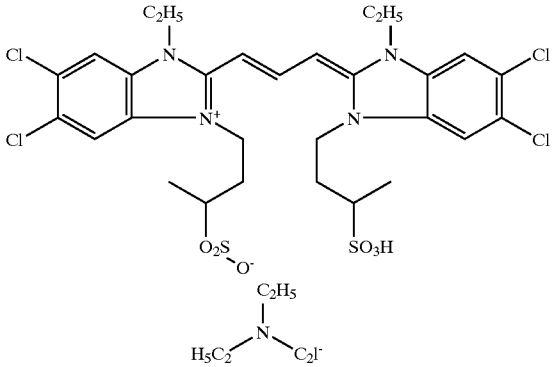

Example 2

In the same way as in Example 1 the Materials Nos. 14–26 were coated. The combination of spectral sensitizing dyes therein has been summarized in the Table 3, whereas the same results obtained with respect to fog, speed, darkroom sensitivity and stain level have been summarized in Table 4.

Same conclusions can be drawn from the results obtained in the Table 4 hereinafter as from those in Table 2 from Example 1.

In the present Example however it has moreover been demonstrated that the ratio amount of the dyes is decisive in order to fully reach the objects of the present invention with respect to speed-darkroom-sensitivity and dye stain level (see inventive samples Nos. 15–17–19–21–23–25 versus comparative samples Nos. 16–18–20–22–24–26).

As has been clearly shown in this Example, the dyes according to the formulae representing the "second spectrally sensitizing dye" may again be symmetric or asymmetric, provided that the conditions as claimed have been fulfilled.

TABLE 3

| Matl No. | 2nd dye (No.) | Amount vs. Dye 1 (%) | 3rd dye (No.) | Amount vs. Dye 1 (%) |
|---|---|---|---|---|
| 14 | — | — | — | — |
| 15 | 6 | 3 | 5 | 1 |
| 16 | 6 | 10 | 5 | 1 |
| 17 | 6 | 3 | 5 | 1 |
| 18 | 6 | 10 | 5 | 1 |
| 19 | 7 | 3 | 5 | 1 |
| 20 | 7 | 10 | 5 | 1 |
| 21 | 8 | 3 | 5 | 1 |
| 22 | 8 | 10 | 5 | 1 |
| 23 | 9 | 3 | 5 | 1 |
| 24 | 9 | 10 | 5 | 1 |

TABLE 3-continued

| Matl No. | 2nd dye (No.) | Amount vs. Dye 1 (%) | 3rd dye (No.) | Amount vs. Dye 1 (%) |
|---|---|---|---|---|
| 25 | 10 | 3 | 5 | 1 |
| 26 | 4 | 3 | 5 | 1 |

TABLE 4

| Matl. No. | F (× 1000) | S (× 100) | DRLS (× 1000) | Stain Level |
|---|---|---|---|---|
| 14 (comp) | 202 | 155 | 0 | 1 |
| 15 (inv) | 204 | 151 | 16 | 1 |
| 16 (comp) | 208 | 147 | 19 | 2 |
| 17 (inv) | 203 | 152 | 13 | 1 |
| 18 (comp) | 207 | 148 | 17 | 2 |
| 19 (inv) | 203 | 153 | 11 | 1 |

TABLE 4-continued

| Matl. No. | F (× 1000) | S (× 100) | DRLS (× 1000) | Stain Level |
|---|---|---|---|---|
| 20 (comp) | 202 | 152 | 18 | 2 |
| 21 (inv) | 208 | 153 | 11 | 1 |
| 22 (comp) | 203 | 153 | 15 | 2 |
| 23 (inv) | 201 | 152 | 10 | 1 |
| 24 (comp) | 201 | 155 | 17 | 2 |
| 25 (inv) | 210 | 149 | 11 | 1 |
| 26 (comp) | 207 | 152 | 10 | 2 |

Having described in detail preferred embodiments of the current invention, it will now be apparent to those skilled in the art that numerous modifications can be made therein without departing from the scope of the invention as defined in the appending claims.

Dye 6

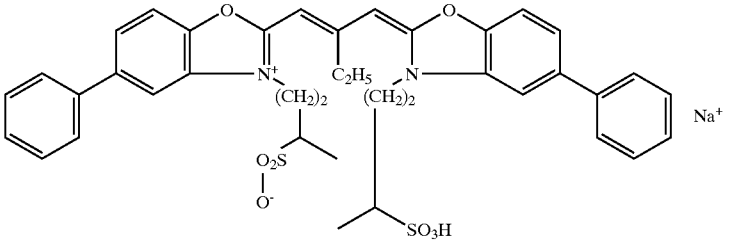

Dye 7

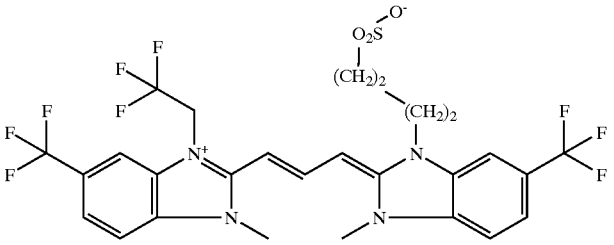

Dye 8

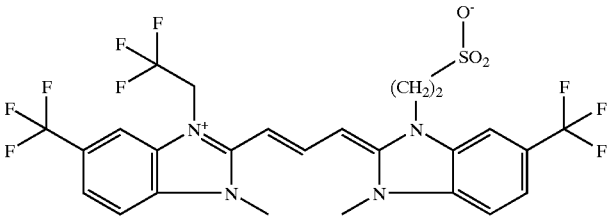

Dye 9

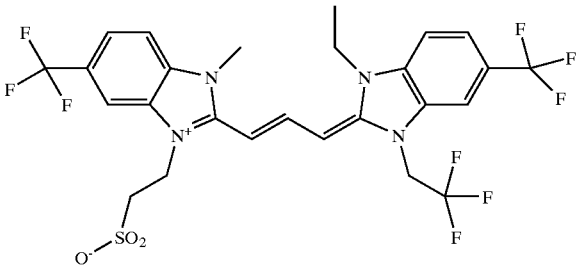

-continued

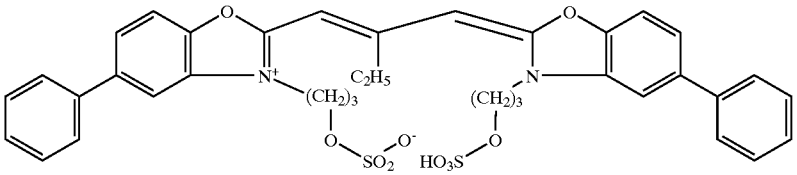

Dye 10

What is claimed is:

1. Chemically and spectrally-sensitized silver halide photographic emulsion having (100) cubic silver bromoiodide grains or crystals with an average edge length of from 0.2 up to 1.5 μm, wherein said grains have been spectrally sensitized in the wavelength range from 540 nm to 555 nm with at least three spectrally sensitizing dyes:

a main spectrally sensitizing dye present in an amount of at least 85 mole %, a second spectrally sensitizing dye present in an amount of less than 10 mole %, and a third spectrally sensitizing dye present in an amount of at most 5 mole %, said amount being expressed in mole % based on total molar amounts of all spectrally sensitizing dyes added;

characterized in that at least said main spectrally sensitizing dye is a methine dye comprising first and second nuclei joined by a substituted or unsubstituted trimethine linkage, wherein at least nuclei are both benzoxazole nuclei, said nuclei being each substituted by one halogen atom or by a methyl group in the 5- and 5'- or 6- and 6'-position respectively; the N-atom of which has a substituted or unsubstituted alkyl chain having from 1 to 4 carbon atoms and a water-soluble group;

at least said third spectrally sensitizing dye is a methine dye comprising first and second nuclei joined by a substituted or unsubstituted trimethine linkage, wherein both nuclei are benzimidazole nuclei, said nuclei substituted by one or more halogen atom(s) in the 5-, 5'-,6- and/or 6'-position, or by a methyl group; the N-atoms of which having a substituted or unsubstituted alkyl chain having from 1 to 4 carbon atoms and a water-soluble group on at least on one N-atom; and in that the said second spectrally sensitizing dye is a trimethine dye comprising first and second nuclei, independently represented by a benzoxazole or a benzimidazole nucleus, at least one of them being substituted by a hydrophobic substituent, having a higher Van der Waals volume than any other hydrophobic substituent of both other spectrally sensitizing dyes.

2. Chemically and spectrally-sensitized silver halide photographic emulsion having (100) cubic silver bromoiodide grains or crystals with an average edge length of from 0.2 up to 1.5 μm and a high degree of monodispersity in that a variation coefficient on said average edge length is less than 0.20, wherein said grains have been spectrally sensitized in the wavelength range from 540 nm to 555 nm with at least three spectrally sensitizing dyes:

a main spectrally sensitizing dye present in an amount of at least 85 mole %, a second spectrally sensitizing dye present in an amount of less than 10 mole %, and a third spectrally sensitizing dye present in an amount of at most 5 mole %, said amount being expressed in mole % based on total molar amounts of all spectrally sensitizing dyes added;

characterized in that at least said main spectrally sensitizing dye is a methine dye comprising first and second nuclei joined by a substituted or unsubstituted trimethine linkage, wherein at least nuclei are both benzoxazole nuclei, said nuclei being each substituted by one halogen atom or by a methyl group in the 5- and 5'- or 6- and 6'-position respectively; the N-atom of which has a substituted or unsubstituted alkyl chain having from 1 to 4 carbon atoms and a water-soluble group;

at least said third spectrally sensitizing dye is a methine dye comprising first and second nuclei joined by a substituted or unsubstituted trimethine linkage, wherein both nuclei are benzimidazole nuclei, said nuclei substituted by one or more halogen atom(s) in the 5-, 5'-,6- and/or 6'-position, or by a methyl group; the N-atoms of which having a substituted or unsubstituted alkyl chain having from 1 to 4 carbon atoms and a water-soluble group on at least on one N-atom; and in that the said second spectrally sensitizing dye is a trimethine dye comprising a benzoxazole nucleus and a benzimidazole nucleus, and wherein, apart from the presence on at least one N-atom of a water-soluble group, other substitutions are providing an asymmetrical structure.

3. Emulsion according to claim 1, wherein said hydrophobic substituent is selected from the group consisting of substituted or unsubstituted phenyl and —$(CH_2)_x$—$CF_3$, wherein x is 0 or an integer having a value of from 1 to 4.

4. Emulsion according to claim 2, wherein said hydrophobic substituent is selected from the group consisting of substituted or unsubstituted phenyl and —$(CH_2)_x$—CF wherein x is 0 or an integer having a value of from 1 to 4.

5. Emulsion according to claim 1, wherein said second spectrally sensitizing dye is a dye selected from the group consisting of the dyes I–VIII, having the formulae Dye I
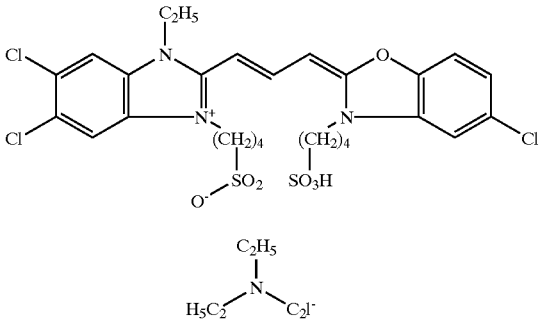
Dye II
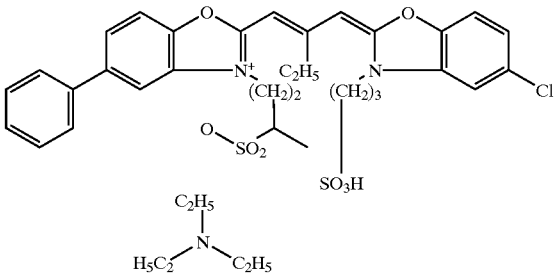
Dye III
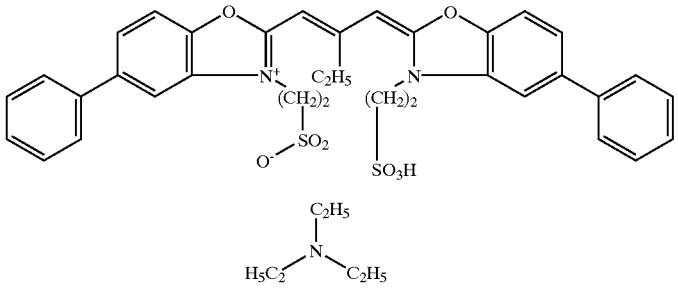
Dye IV
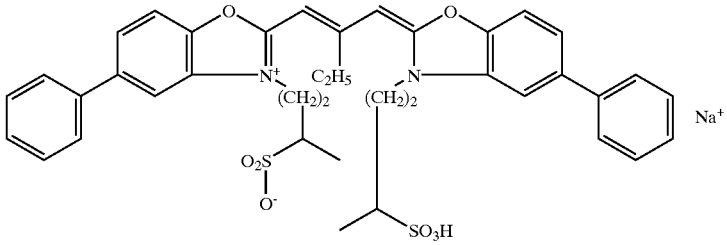
Dye V
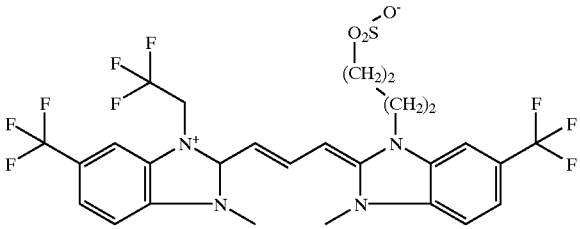
Dye VI
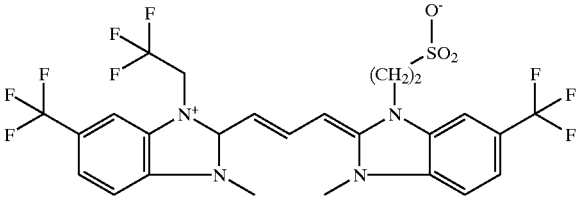
Dye VII
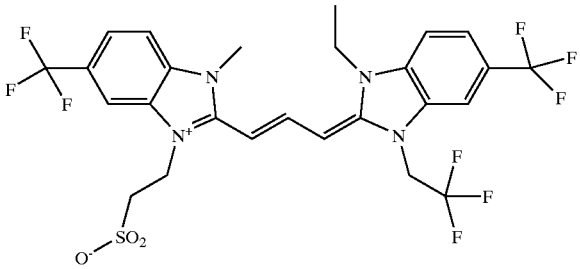
Dye VIII
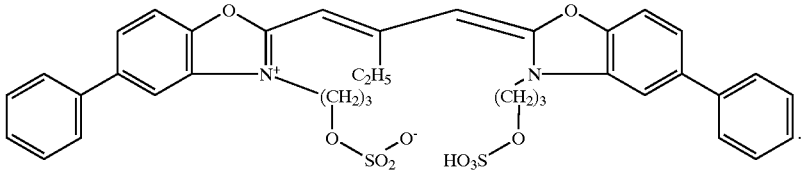

6. Emulsion according to claim 2, wherein said second spectrally sensitizing dye is a dye selected from the group consisting of the dyes I–VIII, having the formulae
Dye I
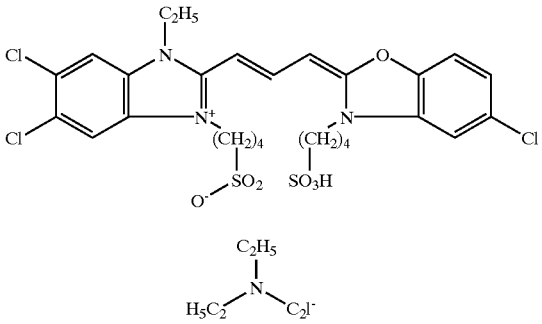
Dye II
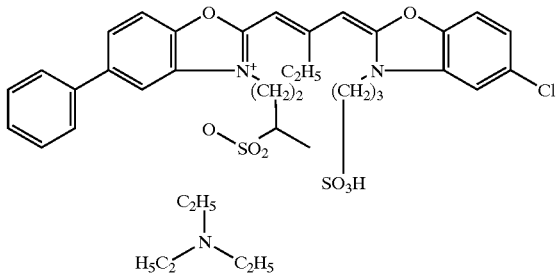
Dye III
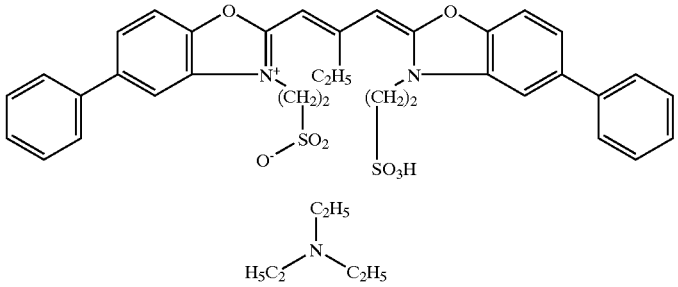
Dye IV
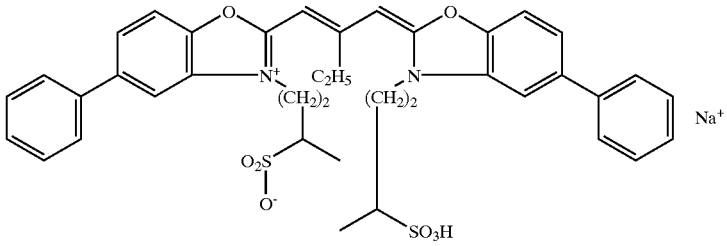
Dye V
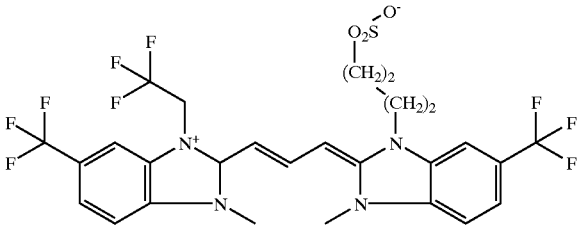
Dye VI
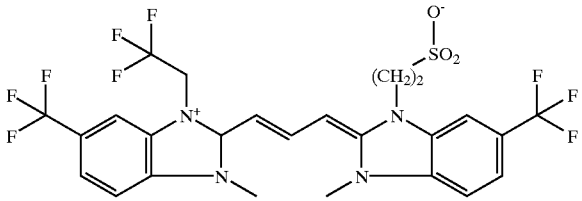
Dye VII
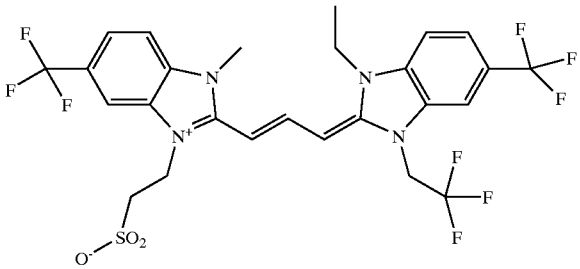

-continued

Dye VIII

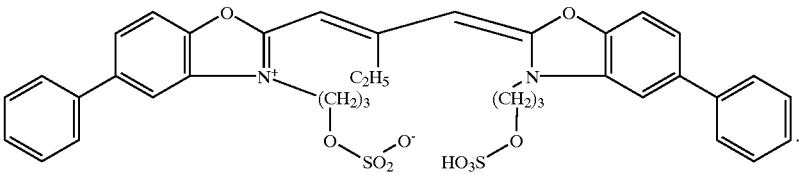

7. Emulsion according to claim 1, wherein said second spectrally sensitizing dye is added in an amount of less than 5 mole % of all spectral sensitizers added.

8. Emulsion according to claim 2, wherein said second spectrally sensitizing dye is added in an amount of less than 5 mole % of all spectral sensitizers added.

9. Emulsion according to claim 1, wherein said second spectrally sensitizing dye is added in an amount of not more than 3 mole % of all spectrally sensitizing dyes added.

10. Emulsion according to claim 2, wherein said second spectrally sensitizing dye is added in an amount of not more than 3 mole % of all spectrally sensitizing dyes added.

11. Emulsion according to claim 1, wherein said third spectrally sensitizing dye is added in an amount of not more than 1 mole % of all spectrally sensitizing dyes added.

12. Emulsion according to claim 2, wherein said third spectrally sensitizing dye is added in an amount of not more than 1 mole % of all spectrally sensitizing dyes added.

13. Emulsion according to claim 1, wherein said cubic grains have a high degree of monodispersity in that a variation coefficient on said average edge length is less than 0.20.

14. Emulsion according to claim 2, wherein said cubic grains have a high degree of monodispersity in that a variation coefficient on said average edge length is less than 0.20.

15. A light-sensitive silver halide photographic film material comprising a support and on one side thereof, at least one light-sensitive emulsion layer having been coated in at least one light-sensitive emulsion layer with the chemically and spectrally sensitized emulsion according to claim 1.

16. A light-sensitive silver halide photographic film material comprising a support and on one side thereof, at least one light-sensitive emulsion layer having been coated in at least one light-sensitive emulsion layer with the chemically and spectrally sensitized emulsion according to claim 2.

17. Radiographic screen/film combination comprising the light-sensitive silver halide photographic film material according to claim 15, in contact with one supported or self-supporting X-ray intensifying screen, characterized in that said supported or self-supporting X-ray intensifying screen essentially consists of luminescent phosphor particles emitting green light in the wavelength range from 540 nm up to 555 nm.

18. Radiographic screen/film combination comprising the light-sensitive silver halide photographic film material according to claim 16, in contact with one supported or self-supporting X-ray intensifying screen, characterized in that said supported or self-supporting X-ray intensifying screen essentially consists of luminescent phosphor particles emitting green light in the wavelength range from 540 nm up to 555 nm.

* * * * *